United States Patent [19]

Sasada et al.

[11] Patent Number: 4,968,246

[45] Date of Patent: Nov. 6, 1990

[54] HEATING APPARATUS

[75] Inventors: Katsumi Sasada, Uda; Nobuhide Nishiyama, Kashihara; Junzo Tanaka, Fujiidera, all of Japan

[73] Assignee: Matsushita Electric Industrial Co., Ltd., Osaka, Japan

[21] Appl. No.: 403,839

[22] Filed: Sep. 5, 1989

Related U.S. Application Data

[63] Continuation of Ser. No. 206,739, Jun. 15, 1988, abandoned.

[30] Foreign Application Priority Data

| | | | |
|---|---|---|---|
| Jun. 18, 1987 | [JP] | Japan | 62-151857 |
| Aug. 31, 1987 | [JP] | Japan | 62-216922 |
| Aug. 31, 1987 | [JP] | Japan | 62-216923 |
| Aug. 31, 1987 | [JP] | Japan | 62-216926 |
| Aug. 31, 1987 | [JP] | Japan | 62-216927 |

[51] Int. Cl.[5] ..... F24C 3/00

[52] U.S. Cl. ..... 431/264; 431/354; 126/214 R; 126/39 R; 126/39 K; 126/39 E; 126/214 A

[58] Field of Search ..... 431/264, 354; 126/39 E, 126/39 K, 214 A, 214 D, 214 R, 39 R

[56] References Cited

U.S. PATENT DOCUMENTS

| | | | |
|---|---|---|---|
| 2,111,369 | 3/1938 | Marvin et al. | 126/214 D X |
| 3,161,191 | 12/1964 | Stoligrosz et al. | 126/214 R X |
| 3,809,055 | 5/1974 | Craver | 126/214 R X |
| 4,541,407 | 9/1985 | Sommers et al. | 126/214 A X |
| 4,565,523 | 1/1986 | Berkelder | 126/39 E X |

*Primary Examiner*—Carl D. Price

*Attorney, Agent, or Firm*—Wenderoth, Lind & Ponack

[57] ABSTRACT

A heating apparatus comprising a burner including a burner body having an air-fuel mixture chamber and a burner cap formed with a plurality of flame ports, a pan formed with an opening for receiving the burner body, a top plate placed on an upper face of the heating apparatus and a trivet placed on the top plate. The burner cap includes a cylindrical portion formed with an air passage, a convex portion projecting upwardly from an inner face of the cylindrical portion and a cover member formed integrally with an upper portion of the cylindrical portion through the convex portion such that a gap is defined between an upper end of the cylindrical portion and a lower face of the cover member.

5 Claims, 5 Drawing Sheets

HEATING APPARATUS

This application is a continuation of now abandoned application, Ser. No. 07/206,739 filed on Jun. 15, 1988, abandoned.

BACKGROUND OF THE INVENTION

The present invention relates to a heating apparatus such as a desk-top kitchen range, a gas cooker, etc. which prevents, during its use, entry of liquid, etc. spilt from an article to be heated, upon heating thereof.

Combustion apparatuses have recently undergone a marked development as is seen from progress of a method of supplying combustion air and fuel to a combustion portion and improvement of operational efficiency and operational feeling. Also in heating apparatuses, a method of supplying combustion air and fuel to a combustion portion has been changed from a Bunsen method to a forced premixed combustion method. Meanwhile, an arrangement of a combustion portion for securing excellent supply of combustion air thereto and improvement of operational efficiency and operational feeling from standpoint of consumers have been under study.

However, the forced premixed combustion method has such drawbacks that the heating apparatus as a whole is made complicated in structure, production cost of the heating apparatus rises due to the need for providing a fan for forcedly premixing combustion air and fuel and work for providing a power source for actuating the fan is required to be performed. Therefore, in heating apparatuses for home use, the Bunsen method is widely employed in which combustion air and fuel are mixed by action of self burning. However, in the Bunsen method, an air passage must be provided at each portion of the heating apparatus. Thus, the Bunsen method has such disadvantages that if liquid, etc. are spilt from an article to be heated, upon heating thereof, the liquid, etc. enter into the heating apparatus through the air passages, so that the interior of the heating apparatus is soiled by the liquid, etc. and service life of the heating apparatus lessens owing to rapid progress of corrosion caused by salt, water or the like contained in the liquid, etc.

Therefore, there is a demand for an inexpensive heating apparatus requiring no work at the time of its installation, which can be operated for a long time and satisfies the operator in operational efficiency and operational feeling.

Methods of supplying combustion air to a combustion portion of a heating apparatus can be roughly classified into three methods, namely the first method in which a entire amount of air neccessary for combustion is preliminarily mixed with fuel so as to be supplied to the combustion portion, a second method in which a portion of the air necessary for combustion is mixed with fuel so as to be supplied to the combustion portion and the remaining necessary amount of air is supplied from the periphery to the combustion portion by diffusion thereof at the time of combustion, and a third method in which the entire amount of air necessary for combustion is supplied to the combustion portion by diffusion. Here, the second method is described.

In the above described second method, an air passage must be provided at each portion of the combustion portion. The air passages can be provided in one of the following three arrangements. In the first arrangement of FIG. 1, air passages 4*a* and 4*b* are, respectively, disposed at a central portion and a peripheral portion of a burner 3 provided in a combustion portion 2 of a heating apparatus 1. In this first arrangement, if liquid is spilt from an article 5 to be heated, upon heating thereof, the liquid flows along a side surface or a bottom surface of the article 5 provided above the burner 3. Hence, the liquid flows into the air passages 4*a* and 4*b* provided at the central portion and the peripheral portion of the burner 3, respectively. As a result, the liquid soils the interior of the heating apparatus 1 or corrosion in the heating apparatus 1 progresses due to salt, water or the like contained in the liquid, thereby resulting in short service life of the heating apparatus 1.

In the second arrangement of FIG. 2, air in an amount necessary for combustion is obtained without providing the air passages 4*a* and 4*b* at the central portion and the peripheral portion of the burner 3, respectively. However, in this second arrangement, since no air passage is provided, a sufficient amount of air is not supplied to the burner 3, so that it is difficult to obtain proper combustion and thus, incomplete combustion is likely to take place. Meanwhile, in order to sufficiently perform supply of air through diffusion thereof, it is also possible to increase a distance between the article 5 and the burner 3. However, in this case, the combustion portion 2 becomes large in size and thus, the heating apparatus 1 as a whole also becomes large in size.

In the third arrangement of FIG. 3, an air passage 4 is provided at the central portion of the burner 3 without providing any air passage at the peripheral portion of the burner 3 and a cover member 6 which does not close the air passage 4 is provided above the air passage 4. The cover member 6 is so provided as to cover the air passage 4 when viewed from above. However, in this third arrangement, since the cover member 6 is provided separately from the burner 3, the operator may either lose the cover member 6 or fail to set the cover member 6 at the time of use of the heating apparatus 1, so that its originally planned effect cannot be achieved.

SUMMARY OF THE INVENTION

Accordingly, an essential object of the present invention is to provide a heating apparatus in which an air passage disposed in a burner of a combustion portion is covered by a cover member formed integrally with the burner such that liquid, etc. spilt from an article to be heated, upon heating thereof are completely prevented from entering into the heating apparatus, with substantial elimination of the disadvantages inherent in conventional heating apparatus of this kind.

In acccordance with the present invention, since the cover member for covering the air passage of the burner is formed integrally with the burner, the possibility is elminated that the operator loses the cover member or fails to set the cover member, so that entry of liquid, etc. from the article into the heating apparatus is prevented at all times.

Furthermore, since the cover member is formed integrally with the burner, the number of components of the heating apparatus is reduced and production cost of the heating apparatus is lowered.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 4:
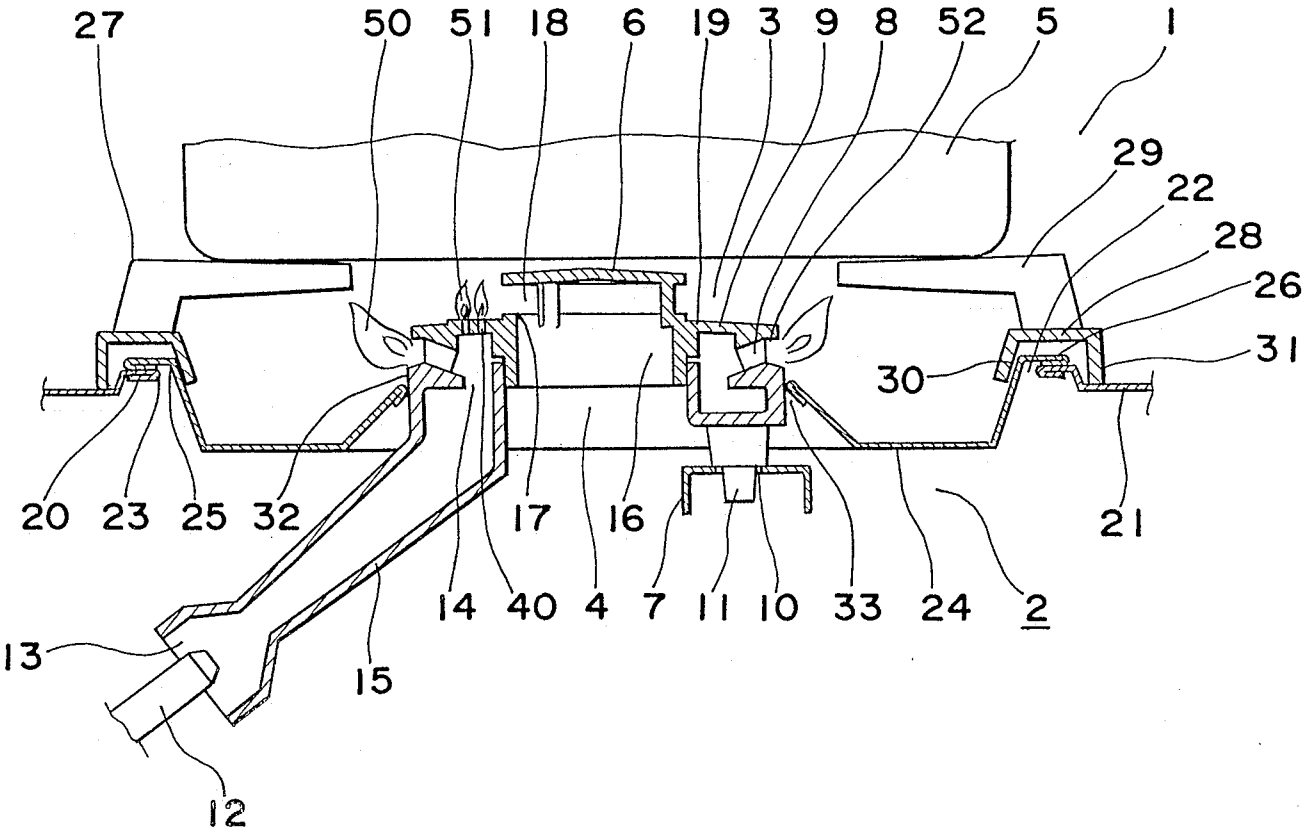
FIG. 4 is a sectional view of a combustion portion of a heating apparatus according to one embodiment of the present invention.

Referring now to the drawings, there is shown in FIG. 4, a heating apparatus 1 according to one embodiment of the present invention. The heating apparatus 1 includes a combustion portion 2. The combustion portion 2 is constituted by a burner 3 placed on a support member 7. The burner 3 includes a burner body 15 and a burner cap 9 placed on the burner body 15. The burner cap 9 has a number of flame ports 8 and a cover member 6. Meanwile, the burner body 15 includes a leg 11 fitted into a hole 10 of the support member 7 and has a hole 13 for receiving a nozzle 12 and an air-fuel mixture chamber 14. A cylindrical portion 16 of the burner cap 9 defines an air passage 4 disposed at a central portion of the burner 3 and is smaller in size than the cover member 6. A first gap 18 is formed between an upper end portion 17 of the cylindrical portion 16 and the cover member 6 so as to open onto an upper face 19 of the burner cap 9 and is communicated with the air passage 4 in the cylindrical portion 16. A top plate 21 has a step portion 20 projecting upwardly into a pan opening 22 and the step portion 20 has an edge 23 formed at a distal end thereof. An outer peripheral portion 25 of a pan 24 is formed smaller than the pan opening 22 such that an outer peripheral edge 26 of the pan 24 is placed on the step portion 20.

A trivet 27 is constituted by a trivet frame 28 and a plurality of support claws 29. The trivet frame 28 has an inner frame portion 30 substantially equal, in size, to the outer peripheral portion 25 of the pan 24. The trivet 27 is secured through engagement between the inner frame portion 30 of the trivet frame 28 and the outer peripheral portion 25 of the pan 24. An outer peripheral portion 32 of the burner body 15 is fitted into a central opening 33 of the pan 24 so as to secure the pan 24.

Figure 1:
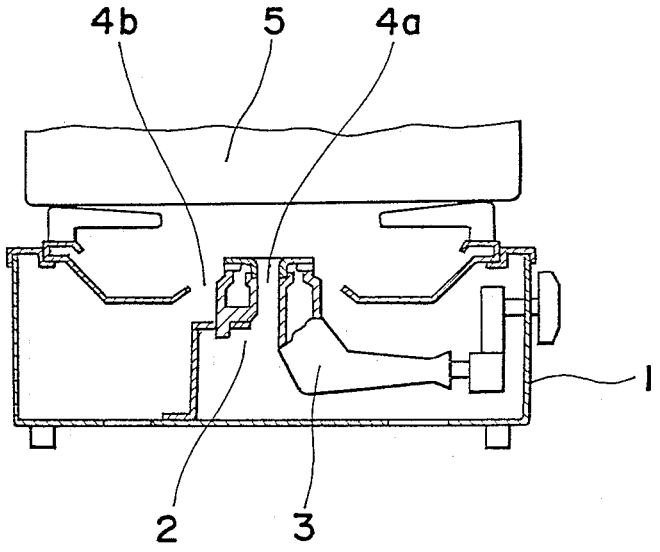
Fig. 1 PRIOR ART
FIGS. 1 to 3 are sectional views of combustion portions of prior art heating apparatuses, respectively (already referred to)
Figure 2:
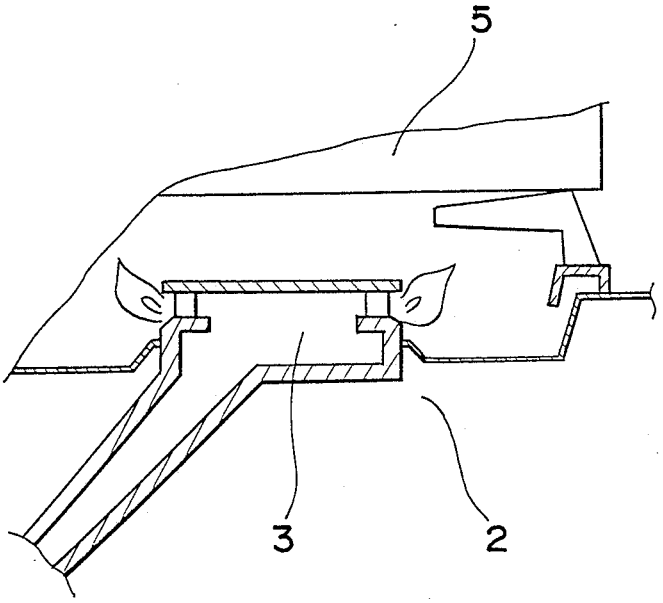
Fig. 2 PRIOR ART
Figure 3:
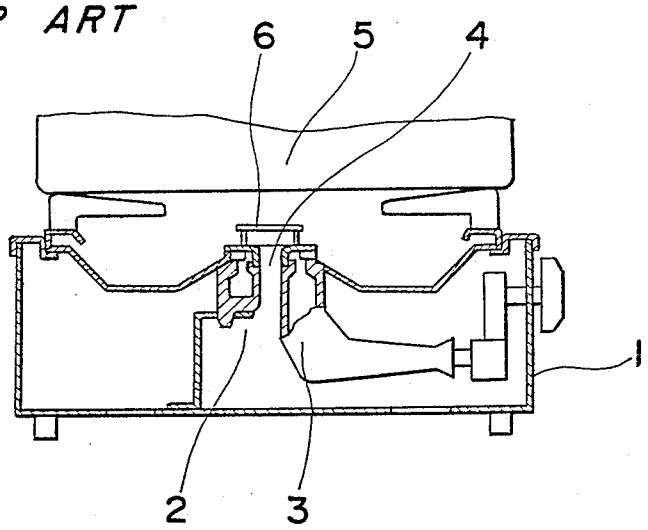
Fig. 3 PRIOR ART
Figure 5:
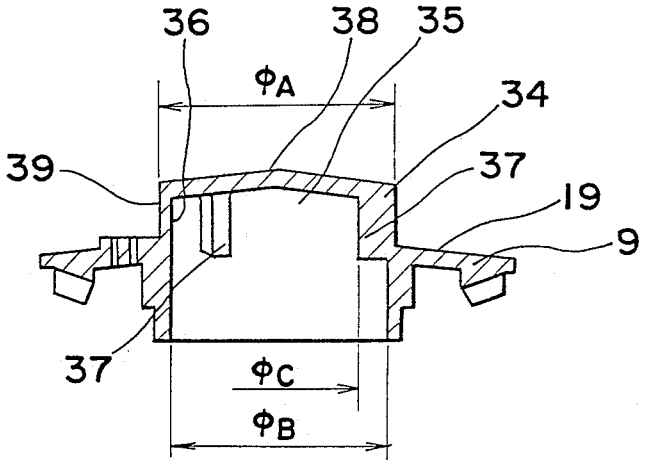
FIG. 5 is a sectional view of a burner employed in the heating apparatus of FIG. 4 and subjected to a primary processing.

FIG. 5 shows the burner cap 9 subjected to a primary processing such as forging , casting, etc. In FIG. 5, a projection 34 forms a cylindrical portion 35 having a closed distal end. A plurality of radially inwardly projecting extensions or convex portions 37 are integrally formed with an inner face 36 of the cylindrical portion 35. An upper end portion 38 of the projection 34 and the upper face 19 are formed downwardly obliquely in a direction oriented radially outwardly towards the flame ports 8. Assuming that characters $\phi A$, $\phi B$ and $\phi C$ denote a size of the projection 34, a size of the cylindrical portion 35 and a size of the convex portions 37, respectively, the following relation is obtained.

$$\phi A > \phi B > \phi C$$

Figure 6:
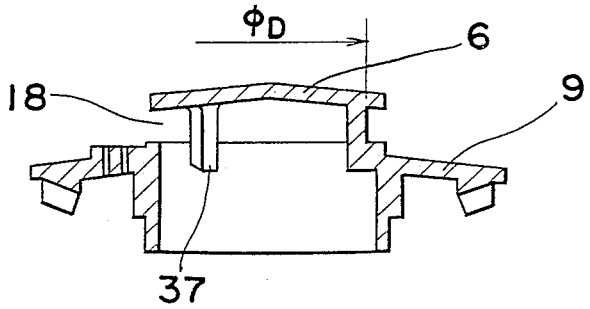
FIG. 6 is a sectional view of the burner of FIG. 4 after its secondary processing.

FIG. 6 shows the burner cap 9 subjected to a secondary processing. Namely, after the primary processing of FIG. 5, the burner cap 9 is subjected to the secondary processing in which an outer peripheral wall 39 of the projection 34 is cut off at a size of $\phi D$ so as to define the gap 18 such that material corresponding to the cover member 6 is left at an upper portion of the projection 34. The cover member 6 is integrally formed with the burner cap 9 through the extensions or convex portions 37. At this time, the sizes $\phi A$ to $\phi D$ satisfy the following relation.

$$\phi A > \phi B > \phi D > \phi C$$

Figure 7:
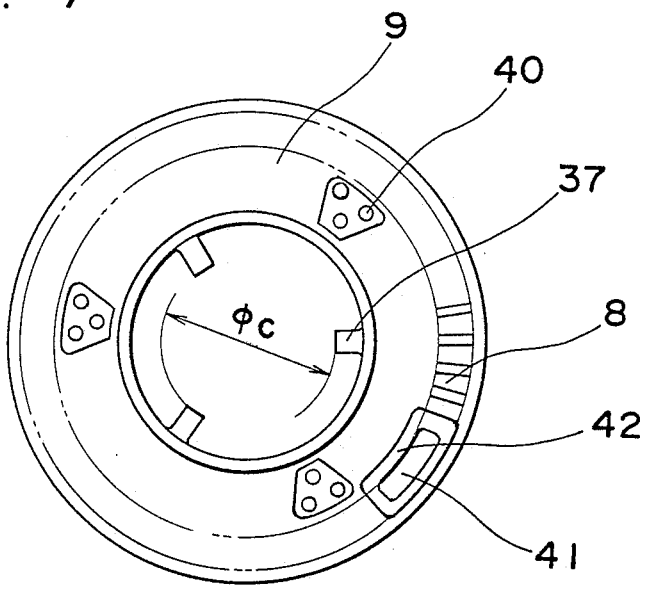
FIG. 7 is a top plan view of the burner of FIG. 4.

As shown in FIG. 7, the burner cap 9 has a plurality of inner flame ports 40 in addition to the flame ports 8. The inner flame ports 40 communicate the air-fuel mixture chamber 14 and the upper face 19 of the burner cap 9. The inner flame ports 40 are radially interposed between the convex portions 37 and the flame ports 8 and circumferentially deviate from the convex portions 37 so as to be circumferentially interposed between each pair of the neighboring convex projections 37 such that each of the inner flame port 40 does not fall on a radial line connecting a central axis of the burner cap 9, through one of the convex portions 37, with a corresponding one of the flame ports 8.

Figure 8:
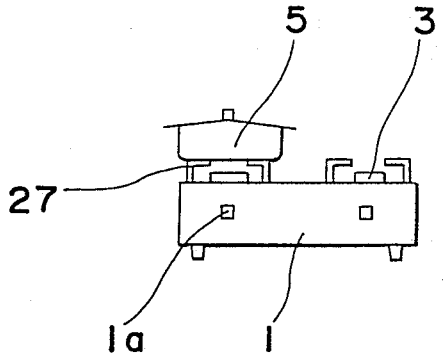
FIG. 8 is a front elevational view of the heating apparatus of FIG. 4.

As shown in FIG. 8, when the heating apparatus 1 is used, the article 5 to be heated is placed on the trivet 27 and an operating portion 1*a* is operated.

Figure 9:
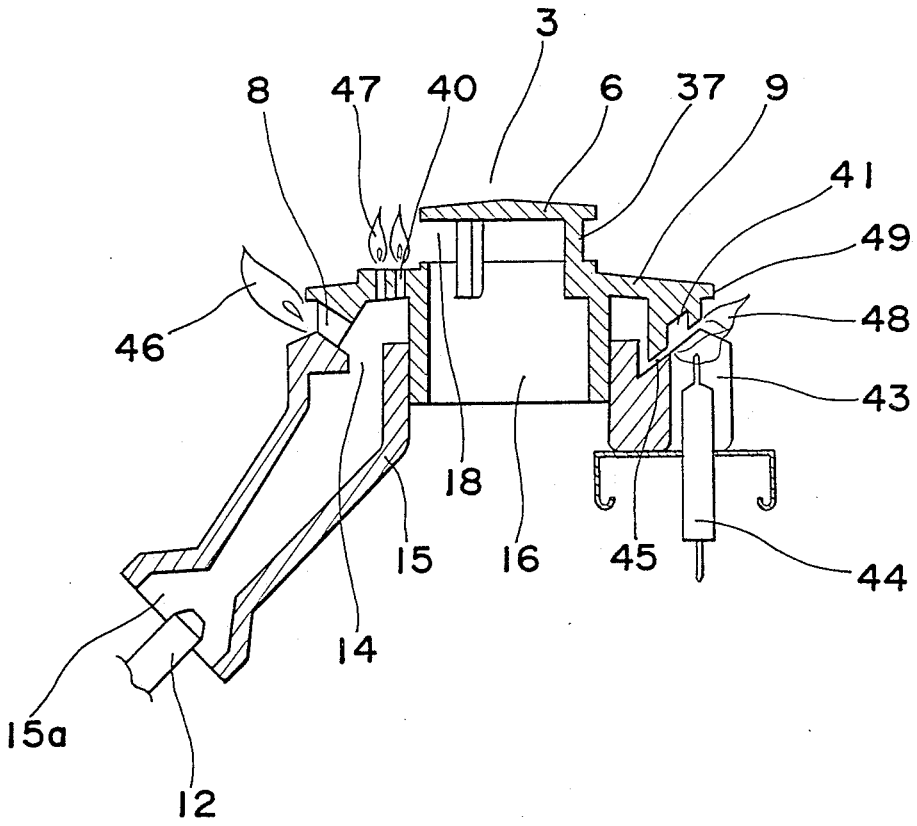
FIG. 9 is a sectional view of an ignition portion of the burner of FIG. 4.

FIG. 9 shows an ignition portion of the burner 3. A closed space 41 extends in a direction identical with that of the flame ports 8 and is enclosed by an interruption portion 40 shown in FIG. 7. A recess 43 is formed at a portion of an outer periphery of the burner body 15 and an ignition electrode 44 is accommodated in the recess 43. The recess 43 and the ignition electrode 44 confront the closed space 41. When the ignition electrode 44 ignites air-fuel mixture flowing through a second gap 45 between the burner body 15 and the burner cap 9 so as to produce an ignition flame 48, the ignition flame 48 moves to the flame ports 8. Meanwhile, fuel injected from the nozzle 12 into the air-fuel mixture chamber 14 draws thereinto air from a periphery 15*a* of the burner 12 by action of flow of the fuel so as to be formed into air-fuel mixture. Main flames 46 are, respectively, produced at the flame ports 8, while inner flames 47 are, respectively, produced at the inner flame ports 40. Air proceeding from the first gap 18 of the cylindrical portion 16 is supplied to the inner flames 47 and a radially inner portion of each of the main flames 46. Air is supplied to the ignition flame 48 and a radially outer portion of each of the main flames 46 from vicinity of the top plate 21 and the pan 24.

In the heating apparatus 1 of the above described arrangement, when liquid is spilt from the article 5 upon heating of the article 5, some portion of the liquid drops directly from the article 5 to the top plate 21 and the pan 24, while another portion of the liquid flows to the bottom surface of the article 5 along the side surface of the article 5 and then, drops to the cover member 6 and the upper face 19 of the burner cap 9. The liquid having dropped to the cover member 6 flows downwardly on the upper end portion 38 inclined outwardly downwardly and drops to the upper face 19 of the burner cap 9. At this time, since the size $\phi A$ of the cover member 6 is made larger than the size $\phi B$ of the cylindrical portion 35 and the gap 18 is formed at an angle of inclination identical with that of the upper end portion 38 of the cover member 6, the liquid having flowed to the outer peripheral portion of the cover member 6 is completely drained onto the upper face 19 of the burner cap 9 and thus, does not flow into the cylindrical portion 35 at all. Subsequently, the liquid having flowed onto the upper face 19 of the burner cap 9 proceeds further towards the flame ports 8 and is drained by a rib 49 provided above the flame ports 8 so as to drop onto the pan 24 disposed below the flame ports 8 and remains on the pan 24.

As described above, the liquid, etc. spilt from the article 5 upon heating thereof are completely received by the pan 24 and the top plate 21 and thus, do not flow into the heating apparatus 1 at all, thereby resulting in long service life of the heating apparatus 1.

Furthermore, since the ignition electrode 44 is also covered by the burner cap 9, the liquid spilt from the article 5 upon heating thereof can be prevented from adhering to the ignition electrode 44, so that improper spark discharge of the ignition electrode 44 can be positively avoided.

As is clear from the foregoing description, in the heating apparatus of the present invention, since the cover member formed integrally with the burner is provided at the air passage formed in the burner of the combustion portion, the number of components of the heating apparatus is reduced, thereby resulting in decrease of production cost of the heating apparatus. Furthermore, since liquid, etc. spilt from the article upon heating thereof are prevented from entering into the heating apparatus, such an undesirable phenomenon does not take place that service life of the heating apparatus is reduced due to corrosion of interior of the heating apparatus by the liquid, etc.

Moreover, in accordance with the present invention, since the ignition portion is covered by the burner, ignition is performed positively without defective spark discharge.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A heating apparatus comprising:

a burner including a burner body and a burner cap disposed on an upper portion of said burner body, said burner body having an air-fuel mixture chamber, said burner cap having a plurality of flame ports defined at its periphery, said burner cap including a cylindrical portion which has a longitudinal axis, said cylindrical portion having a cylindrical inner face defining an air passage therein, said cylindrical inner face having a diameter B with respect to said axis, at least one extension having upper and lower ends, said lower end of said at least one extension being integrally formed with an upper portion of said cylindrical portion, and said at least one extension projecting upwardly from said inner face of said cylindrical portion, said at least one extension having an inner face and an outer face with diameters C and D, respectively, with respect to said axis, a cover member integrally formed with said upper end of said at least one extension, said cover member having a diameter A with respect to said axis and defining a gap between said upper portion of said cylindrical portion and said cover member, said gap fluidly communicating said plurality of flame ports and said air passage in said cylindrical portion for supplying air from said air passage to said plurality of flame ports, and wherein the relative sizes of said diameters follows the relation $A>B>D>C$;

a pan having an opening for receiving said burner body therein;

a top plate for supporting said pan; and a trivet for supporting an article to be heated, and said trivet being disposed on said top plate.

2. A heating apparatus as claimed in claim 1, wherein a diameter of said opening of said pan is substantially equal to a diameter of said outer periphery of said burner body, said top plate has a pan opening for receiving said pan therein, and said pan opening has a diameter substantially equal to an outside diameter of said pan.

3. A heating apparatus as claimed in claim 1, wherein at least one inner flame port is defined in said burner cap, each said inner flame port being disposed between said plurality of flame ports and said cover member, and each said inner flame port is within a respective area radially angularly offset from a radial line extending radially outwardly from a center of said burner cap and extending through said at least one extension.

4. A heating apparatus comprising:

a burner including a burner body and a burner cap disposed on an upper portion of said burner body, said burner body having an air-fuel mixture chamber, said burner cap having a plurality of flame ports defined at its outer periphery, said burner cap including a cylindrical portion, said cylindrical portion having an inner face defining an air passage therein, at least one extension having upper and lower ends, said at least one extension being integrally formed with and projecting from said inner face of said cylindrical portion at an upper portion thereof, a cover member integrally formed with said upper end of said at least one extension for defining a first gap between said upper portion of said cylindrical portion and said cover member, said first gap fluidly communicating said plurality of flame ports and said air passage in said cylindrical portion for supplying air from said air passage to said plurality of flame ports, said burner body further having a contact surface and a recess defined in the outer periphery thereof, said burner cap further having an interruption portion defining a space recessed in a direction substantially the same as said plurality of flame ports, lower portions of said plurality of flame ports contacting said contact surface of said burner body, and a second gap being defined between said interruption portion and a face of said recess, said face being disposed at said contact surface of said burner;

an ignition electrode being disposed in said recess, and said ignition electrode being disposed inwardly of said outer periphery of said burner cap;

a pan having an opening for receiving said burner body therein;

a top plate for supporting said pan; and a trivet for supporting an article to be heated, and said trivet being disposed on said top plate.

5. A heating apparatus comprising:

a burner including a burner body and a burner cap disposed on an upper portion of said burner body, said burner body having an air-fuel mixture chamber, said burner cap having a plurality of flame ports defined at its periphery, said burner cap including a cylindrical portion which thereby defines a longitudinal axis, said cylindrical portion having a cylindrical inner face defining an air passage therein, said cylindrical inner face having a diameter B with respect to said axis, at least one extension having upper and lower ends, said lower end of said at least one extension being integrally attached to an upper portion of said cylindrical portion, and said at least one extension projecting upwardly from said inner face of said cylindrical portion, said at least one extension having an inner face and an outer face with diameters C and D, respectively, with respect to said axis, a cover member integrally attached to said upper end of said at least one extension, said cover member having a diameter A with respect to said axis and defining a gap between said upper portion of said cylindrical portion and said cover member, said gap fluidly communicating said plurality of flame ports and said air passage in said cylindrical portion for supplying air from said air passage to said plurality of flame ports, and wherein the relative sizes of said diameters follows the relation $A>B>D>C$ and;

a trivet for supporting an article to be heated and for maintaining a predetermined distance between an article to be heated and said cover member when an article to be heated is received on said trivet.

* * * * *